US006779961B2

(12) United States Patent
Barney et al.

(10) Patent No.: US 6,779,961 B2
(45) Date of Patent: Aug. 24, 2004

(54) MATERIAL HANDLER WITH ELECTRONIC LOAD CHART

(75) Inventors: Joseph S. Barney, Carlisle, PA (US); G. Louis Troppman, III, Maugansville, MD (US); Michael P. Macdonald, Chambersburg, PA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/013,051

(22) Filed: Oct. 29, 2001

(65) Prior Publication Data

US 2003/0082041 A1 May 1, 2003

(51) Int. Cl.[7] ..... B66C 23/04

(52) U.S. Cl. ..... 414/728; 414/699; 414/685; 212/278

(58) Field of Search ..... 414/680, 685, 414/718, 728, 699; 212/278; 352/131, 132; 180/948, 41, 906; 340/705; 350/172

(56) References Cited

U.S. PATENT DOCUMENTS 3,641,551 A 2/1972 Sterner et al.
3,740,534 A 6/1973 Kezer et al.
4,216,868 A 8/1980 Geppert
4,218,837 A * 8/1980 Peterman ..... 414/685 X
4,544,071 A 10/1985 Poock
4,583,908 A * 4/1986 Crawford ..... 414/685 X
5,058,752 A 10/1991 Wacht et al.
5,160,056 A * 11/1992 Yoshimatsu et al. .... 212/278 X
5,711,440 A 1/1998 Wada
5,731,987 A 3/1998 Strong et al.
5,732,835 A 3/1998 Morita et al.
6,041,582 A * 3/2000 Tiede et al. ..... 56/10.2 C

* cited by examiner

*Primary Examiner*—Donald W. Underwood
(74) *Attorney, Agent, or Firm*—Michael Best & Friedrich LLP

(57) ABSTRACT

The present invention is directed to a material handler that includes a frame, a telescoping boom, a boom extension sensor, a boom angle sensor, and a control system. The telescoping boom is coupled to the frame, pivotable between a lowered and a raised position, and movable between a retracted and an extended position. The boom extension sensor generates a first signal that corresponds to the distance which the boom is extended. The boom angle sensor generates a second signal that corresponds to the angle which the boom is pivoted. The control system receives the signals and displays a cursor located at a position that is based on the first signal and the second signal.

12 Claims, 3 Drawing Sheets

MATERIAL HANDLER WITH ELECTRONIC LOAD CHART

FIELD OF THE INVENTION

The invention relates to material handlers, and more particularly to material handlers with telescoping booms.

BACKGROUND OF THE INVENTION

Material handlers are vehicles that include telescoping booms which are used to lift and transport loads. A typical telescoping boom includes a rearward end that is coupled to a back end of the material handler and a forward end that extends toward a front end of the material handler. The telescoping boom is extendable between a retracted position where the forward end of the boom is approximately located adjacent to the front end of the material handler and an extended position where the forward end of the telescoping boom is extended away from the front end of the material handler. The telescoping boom is also pivotable with respect to material handler between a lowered position where the telescoping boom is substantially horizontal and adjacent to the material handler, and a raised position where the telescoping boom is angled upward from the back end of the material handler such that the forward end of the telescoping boom is raised above the material handler. The telescoping boom is typically equipped with a fork that is insertable underneath a load in order to raise the load and move it to another position.

The load is moved relative to the material handler and therefore it is possible to locate the load into a position that will cause the material handler to become unbalanced and, in extreme circumstances, cause the material handler to roll over. In order to prevent these unsafe conditions, operators of material handlers have historically referred to printed load charts. A typical load chart is illustrated in FIG. 1 and graphically displays safe combinations of extension distances and elevation angles for different load weights. For example, when the material handler is in a static condition, the operator can determine how far the telescoping boom can be safely extended by referencing the elevation angle of the boom and load weight on the chart. Some systems display the distance that the load is extended so that the operator can more accurately determine the other variables from the chart and other systems include warning signals that inform the operator when an unsafe condition exists.

SUMMARY OF THE INVENTION

The electronic load chart of the present invention enhances forward stability by identifying when a material handler is operating at a stable loading condition and by accurately indicating when the material handler is operating close to an unstable loading condition based on a distance that a telescoping boom is extended and an angle that the boom is raised. The electronic load chart also increases the overall efficiency of an operator and the material handler by eliminating the need for the operator to flip through manual load charts to determine the safety of a loading condition and by providing the operator with a display that is based on automatically sensed parameters such as boom extension distance and boom angle.

The present invention is directed to a material handler that includes a frame, a telescoping boom, a boom extension sensor, a boom angle sensor, and a control system. The telescoping boom is coupled to the frame, pivotable between a lowered and a raised position, and movable between a retracted and an extended position. The boom extension sensor generates a first signal that corresponds to the distance which the boom is extended. The boom angle sensor generates a second signal that corresponds to the angle which the boom is pivoted. The control system receives the signals and displays a cursor located at a position that is based on the first signal and the second signal.

The present invention is also directed to a method of displaying a load relative to a material handler including providing a telescoping boom that is coupled to a frame. The telescoping boom is movable between a retracted and an extended position and pivotable between a lowered and a raised position. The method further includes sensing the distance that the telescoping boom is extended, generating a first signal based on the sensed distance, sensing the angle that the telescoping boom is pivoted, generating a second signal based on the sensed angle, and displaying a cursor at a position based on the first signal and the second signal.

Other features and advantages of the invention will become apparent to those skilled in the art upon review of the following detailed description, claims, and drawings.

Figure 1:
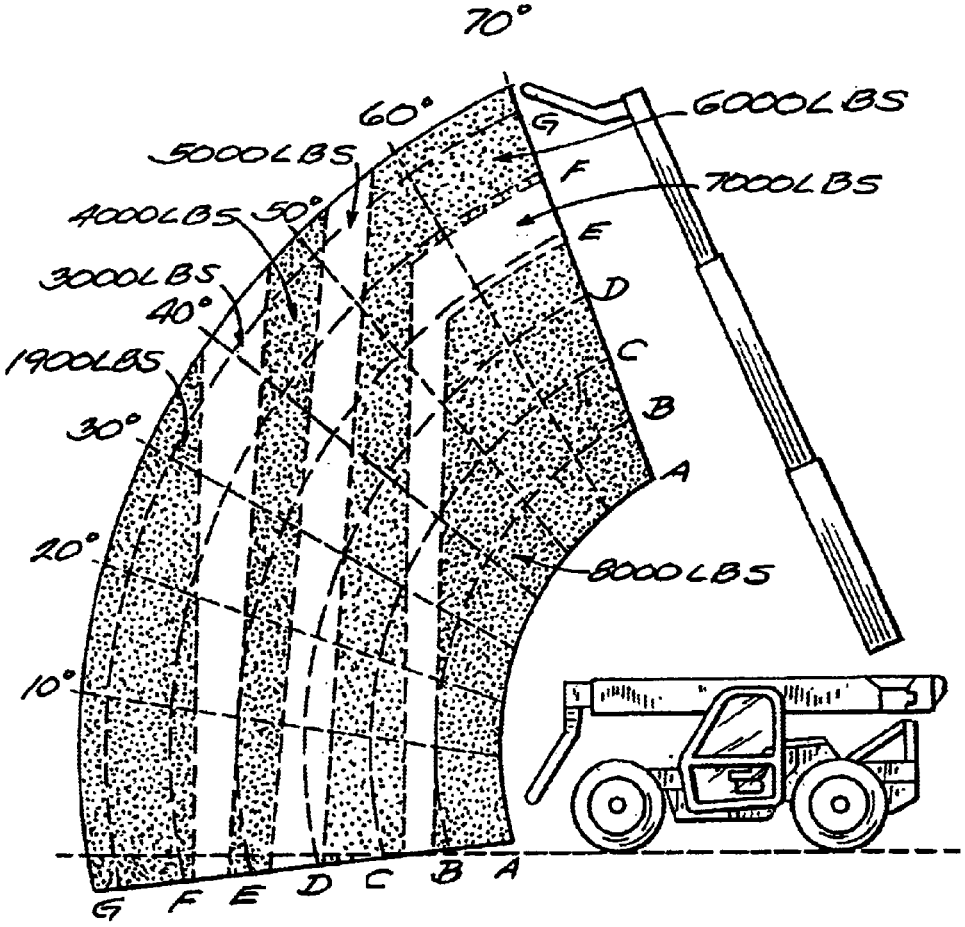
Fig. 1 PRIOR ART
FIG. 1 is a view of a prior art load chart.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Figure 2:
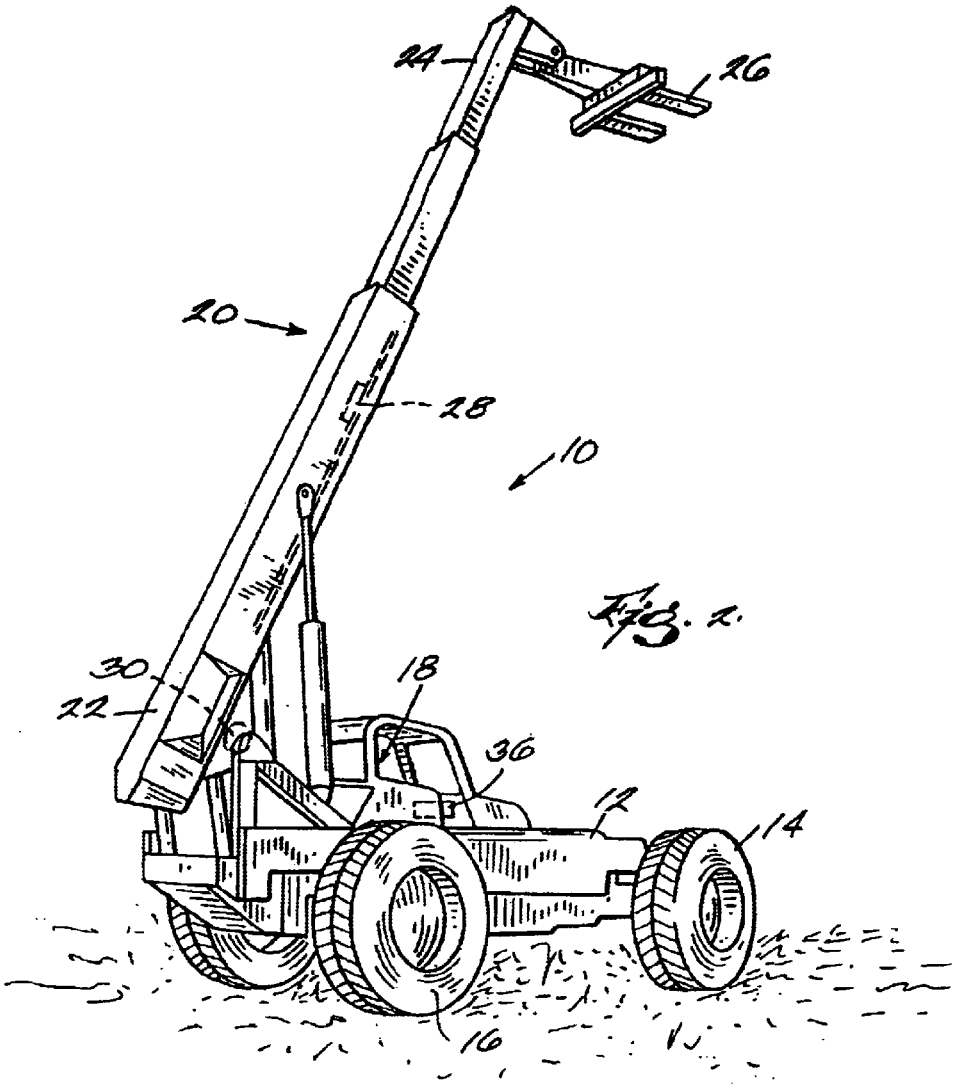
FIG. 2 is a perspective view of a material handler embodying the present invention.

FIG. 2 illustrates a material handler 10 of the present invention. The material handler 10 includes a frame 12, and front and rear wheels 14, 16 supporting the frame 12 for movement over the ground. The frame 12 has front and back ends (right and left ends in FIG. 2). The material handler 10 includes an engine (not shown) that is operably coupled to the wheels 14, 16. The material handler 10 includes an operator's station 18 that is centrally located above the frame 12.

The material handler 10 includes a telescoping boom 20 that is used to lift and transport loads. The telescoping boom 20 includes a rearward or lower end 22 that is coupled to the back end of the frame 12 and a forward or upper end 24 that extends toward the front end of the frame 12. The telescoping boom 20 is extendable between a retracted position and an extended position and pivotable between a lowered position and a raised position. The telescoping boom 20 is extended and pivoted by respective hydraulic cylinders (not shown) that are controlled by the operator from the operator's station 18. The telescoping boom 20 is equipped with an attachment 26 that is utilized to raise and move a load to another position. The attachment 26 can include a fork, bucket, truss boom, or any other attachment that is known to those of ordinary skill in the art.

The material handler 10 also includes an extension sensor 28 and an angle sensor 30. The extension sensor 28 is located on the telescoping boom 20 and generates a first signal that corresponds to the distance that the boom 20 is extended from the retracted position. The angle sensor 30 is located on the lower end 22 of the extension boom 20 and generates a second signal that corresponds to the angle that the boom 20 is pivoted from the lowered position. In the illustrated embodiment, the extension sensor 28 is a Spherosyn Transducer Assembly manufactured by Newall Electronics, Inc., and the angle sensor 30 is an Accustar Ratiometric Clinometer manufactured by Schaevitz Sensors Co. The specific configurations of these sensors 28, 30 are not discussed in detail because sensors which generate signals that represent measured distances and angles are well known to those of ordinary skill in the art.

Figure 3:
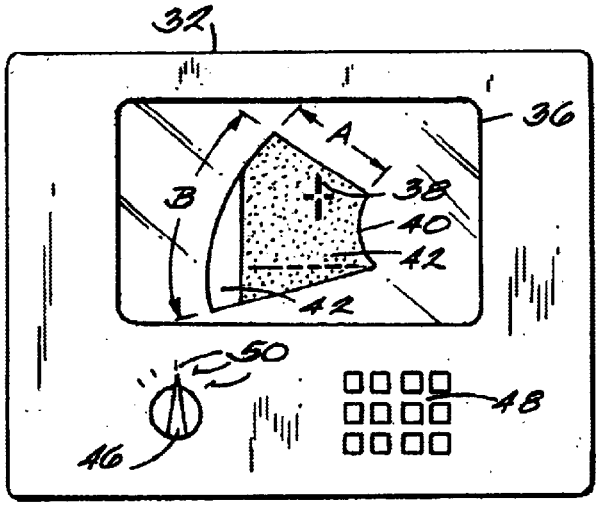
FIG. 3 is a front view illustrating a control system of the material handler shown in FIG. 2.
Figure 4:
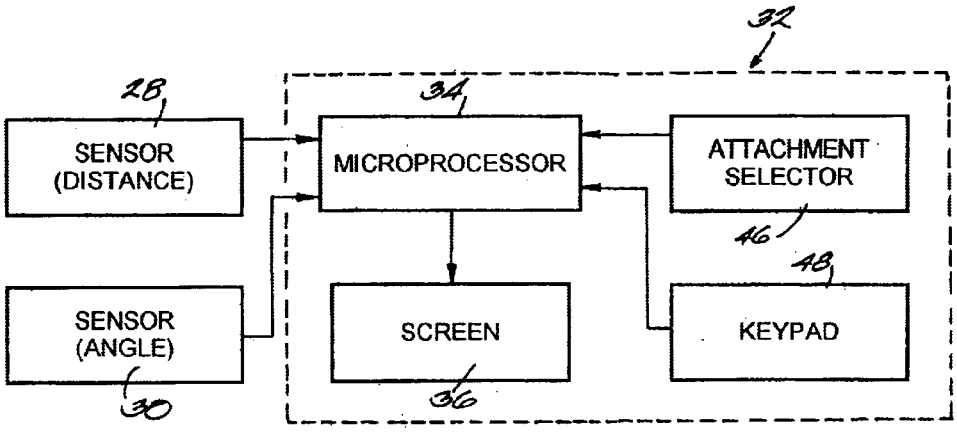
FIG. 4 is a schematic view illustrating the control system shown in FIG. 3.

As shown in FIG. 3 and schematically in FIG. 4, the material handler 10 includes a control system 32 that has a controller 34, such as a microprocessor, and a screen 36. One such commercially available microprocessor is Part No. ELD1-1, which is manufactured by Orvitek. The controller 34 receives the first and second signals and displays on the screen 36 a cursor 38 that is located at a position that is based on the first signal and the second signal and that indicates the position of the forks 26. The cursor 38 can be any visual cue that identifies a position. The screen 36 is mounted in the operator's station 18 and is preferably a thin film electroluminescent display that is capable of displaying a wide range of graphics.

The screen 36 also displays the cursor 38 relative to a boundary 40 that defines a safe zone 42 in which the material handler 10 is stable and an unsafe zone 44 in which the material handler 10 is unstable. The material handler 10 is likely to tip over when the material handler 10 is unstable. For example, when a load supported by the telescoping boom 20 is extended or raised beyond a certain condition, the material handler 10 will tip in the forward direction.

The boundary 40 is shaped similar to a portion of the load chart in FIG. 1. Referring to FIG. 3, a first dimension A is defined by the distance that the telescoping boom 20 is allowed to extend in the unloaded condition and a second dimension B is defined by the angles through which the telescoping boom 20 is allowed to pivot in the unloaded condition. The first signal determines the position of the cursor 38 along the first dimension A and the second signal determines the position of the cursor along the second dimension B. The location of the cursor 38 relative to the boundary 40 automatically changes as the position of the telescoping boom 20 changes. Accordingly, the operator is immediately informed by the location of the cursor 38 relative to the boundary 40 how far the telescoping boom 20 can be safely extended or raised.

The control system 32 also includes an attachment selector 46 and a keypad 48. The attachment selector 46 is a switch that is selectively adjustable by the operator between a number of different positions 50. Each position 50 on the attachment selector 46 generates an attachment signal that corresponds to a different type of attachment 26. The control system 32 must differentiate between the differently shaped attachments 26 because the loads that are supported by the attachments 26 are positioned in different locations relative to the forward end 24 of the telescoping boom 20. The keypad 48 generates a weight signal that corresponds to a weight of the load that is entered by the operator. The controller 34 receives the attachment and weight signals and automatically varies the displayed boundary 40 based on the attachment and weight signals. Generally, the shape of the boundary 40 changes when the attachment signal changes and the size of the displayed boundary 40 decreases when the magnitude of the entered weight increases. Although the attachment signal is manually selected and the weight signal is manually entered, sensors that automatically generate the attachment and weight signals can also be used and are within the scope of the present invention.

We claim:

1. A material handler capable of lifting a load that has a load weight, the material handler comprising:

a frame configured for movement over the ground so as to transport the load;

a telescoping boom coupled to the frame, the telescoping boom being extendable between a retracted position and an extended position, and pivotable between a lowered position and a raised position;

one of a first boom attachment and a second boom attachment coupled with the boom upper end and configured to support the load generally proximal to the upper end;

a boom extension sensor that generates a first signal corresponding to the distance the boom is extended;

a boom angle sensor that generates a second signal corresponding to the angle the boom is pivoted; and a control system that displays a cursor located at a position that is based on the first signal and the second signal to indicate to the operator when the material handler is operating at a safe loading condition and displays a boundary that defines a first zone in which it is safe to operate the boom and a second zone in which it is unsafe to operate the boom, wherein the control system is configured to selectively display a first boundary for the first boom attachment and to alternatively display a second boundary for the second boom attachment.

2. The material handler of claim 1, wherein the control system receives the first and second signals.

3. The material handler of claim 1, wherein the distance that the telescoping boom is extended is measured relative to the retracted position.

4. The material handler of claim 1, wherein the angle that the telescoping boom is pivoted is measured relative to the lowered position.

5. The material handler of claim 1, wherein the control system includes a screen that displays the cursor.

6. The material handler of claim 5, wherein the location of the cursor on the screen is defined by a first dimension based on the first signal and a second dimension based on the second signal.

7. The material handler of claim 1, wherein the material handler is likely to tip over when the cursor is located within the second zone.

8. The material handler of claim 1, wherein the first boom attachment is one of a fork, a bucket, and a truss boom and the second boom attachment is another one of the fork, the bucket, and the truss boom.

9. The material handler of claim 1, wherein the control system includes a switch that selectively adjusts the boundary between the first boundary and the second boundary.

10. The material handler of claim 1, wherein the control system includes a keypad, the weight of the load being manually entered by an operator on the keypad to adjust the boundary for different load weights.

11. A material handler capable of lifting a load that has a load weight, the material handler comprising:

a frame supported for movement over the ground;

a telescoping boom coupled to the frame, the telescoping boom being extendable between a refracted position and an extended position, and pivotable between a lowered position and a raised position, the telescoping boom including a boom attachment;

a boom extension sensor that generates a first signal corresponding to the distance the boom is extended;

a boom angle sensor that generates a second signal corresponding to the angle the boom is pivoted; and a control system that receives the first and second signals, the control system including a screen that displays a boundary that defines a first zone in which it is safe to operate the boom and a second zone in which it is unsafe to operate the boom and that displays a cursor located at a position that indicates to the operator when the material handler is operating at a safe loading condition, wherein the location of the cursor on the screen is defined by a first dimension based on the first signal and a second dimension based on the second signal, a switch that selectively adjusts the boundary for different boom attachments, and a keypad that selectively adjusts the boundary for different load weights.

12. A material handler capable of lifting a load that has a load weight, the material handler comprising:

a frame supported for movement over the ground;

a telescoping boom coupled to the frame, the telescoping boom being extendable between a retracted position and an extended position, and pivotable between a lowered position and a raised position, the telescoping boom including a boom attachment;

a boom extension sensor that generates a first signal corresponding to the distance the boom is extended;

a boom angle sensor that generates a second signal corresponding to the angle the boom is pivoted; and a control system that displays a boundary that defines a first zone in which it is safe to operate the boom and a second zone in which it is unsafe to operate the boom and a cursor located at a position within the boundary that is based on the first signal and the second signal so as to indicate to the operator when the material handler is operating at a safe loading condition, the control system being adjustable to display the boundary for different boom attachments and having a switch that selectively adjusts the boundary for different boom attachments.

* * * * *